United States Patent [19]

Morgan

[11] 4,426,779

[45] Jan. 24, 1984

[54] CLASP KNIFE HOLDER

[76] Inventor: Orrin B. Morgan, 214 Chicago Ave., Kalamazoo, Mich. 49001

[21] Appl. No.: 338,223

[22] Filed: Jan. 11, 1982

[51] Int. Cl.[3] ..... B26B 29/02

[52] U.S. Cl. ..... 30/138; 30/158

[58] Field of Search ..... 30/151, 158, 159, 160, 30/138, 161, 296; 224/232; 51/214

[56] References Cited

U.S. PATENT DOCUMENTS

| | | | |
|---|---|---|---|
| 2,261,267 | 11/1941 | Metz | 30/160 |
| 2,767,530 | 10/1956 | Paldanius | 30/138 X |
| 3,958,330 | 5/1976 | Hutchens | 30/151 |
| 4,152,831 | 5/1979 | Davies | 30/231 |

OTHER PUBLICATIONS

Fruit Clipper, Ferramenta Casalinghi, of May 1969, Italy.

*Primary Examiner*—Jimmy C. Peters
*Attorney, Agent, or Firm*—Gordon W. Hueschen

[57] ABSTRACT

There is disclosed a holder for a clasp knife in which the blade is held in a slot in a partly open condition but with the blade still spring-pressed to closed position so that the handle of the blade is held tightly in the holder and yet is accessible to the hand of the user and can be pulled outwardly and upwardly in one smooth motion to both release the knife from the holder and to open the blade. The holder has a slotted face conforming to the front of the knife and a roller spanning the slot in position to be engaged by the tip of the knife blade so that the spring-bias to closed position will pull the handle of the knife into juxtaposition with the slotted face. The holder has bottom and top projections adapted to hold the pivot end and free end of the knife against longitudinal movement. The bottom projection has a dish-shaped depression therein to hold the pivoted end against being withdrawn from the holder until after the free end has been withdrawn. It also has a lip acting as a fulcrum to force the blade upwardly as the handle is brought down in the initial movement. Then, when the handle is brought upwardly, the blade rides against the roller and is pulled open as the movement of the handle continues upwardly.

19 Claims, 7 Drawing Figures

Fig. 1.
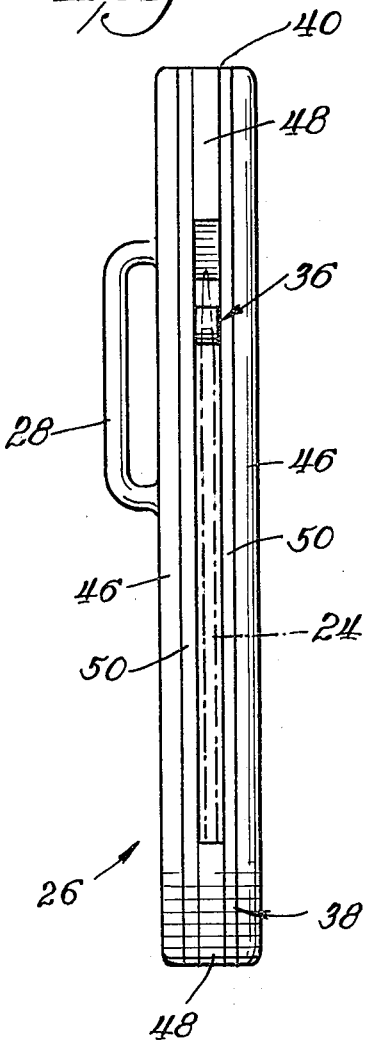
Fig. 2.
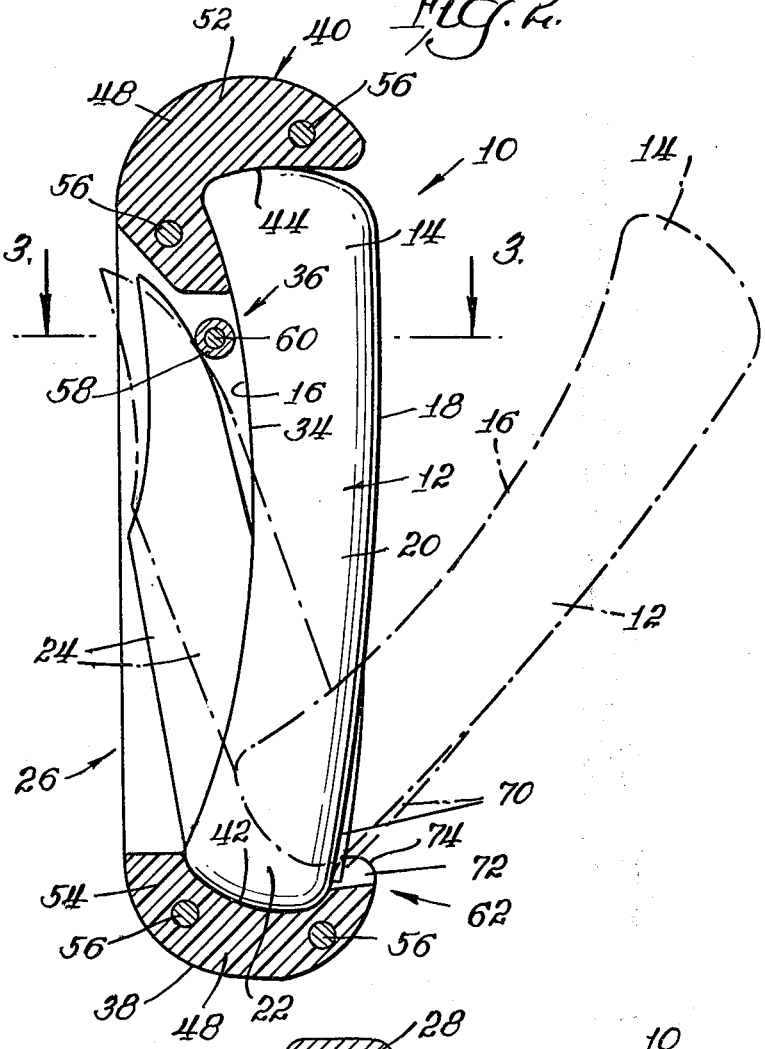
Fig. 3.
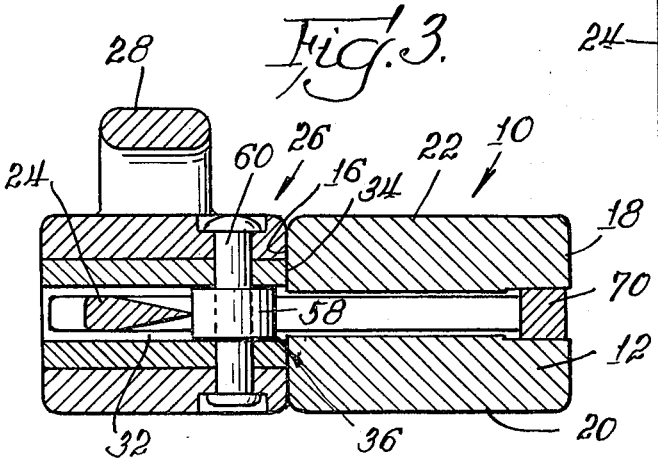
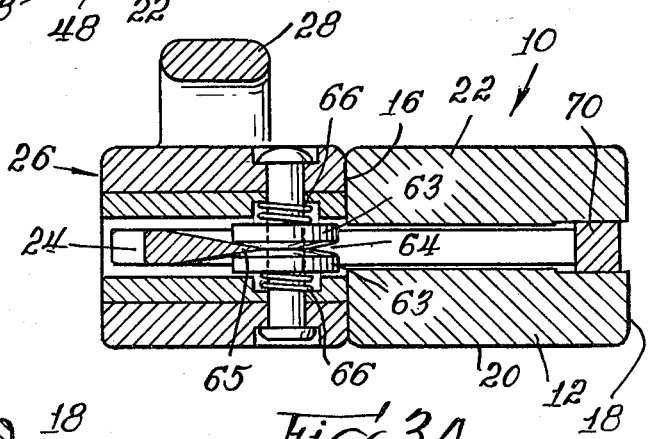
Fig. 3A.

40
52
56
44
56
36
58
60
24
10
12
14
16
16
12
70
22
28
26
32
34
30
74
72
42
62
56
56
30
54

126
136
128

28
68
63
64
68
26

CLASP KNIFE HOLDER

BACKGROUND OF THE INVENTION

Field of Invention and Prior Art

This invention relates to a clasp knife holding device and is particularly directed such device for holding a clasp knife or a jackknife or the like in such a manner that it is readily available to the user.

A clasp knife, according to *WEBSTERS THIRD NEW INTERNATIONAL DICTIONARY,* G. & C. Merriam Company, Springfield, Mass., U.S.A. (1963), is a large pocket knife, the blade or blades of which fold or shut into the handle. A jackknife is defined as a large one-bladed knife having a catch to hold the blade open rigidly. Other dictionaries have similar definitions, though not always the same. As far as this invention is concerned, it is to be understood that a clasp knife is a large pocket knife containing one or more blades which fold into the handle and are spring-biased to closed position and to open position. It is particularly useful in connection with one-bladed folding knives of the class described having a catch to hold the blade open rigidly.

Such knives are commonly used by hunters and have the advantage over hunting knives in that the blade can be folded away into the handle where it is less likely to cause injury through careless handling. The hunting knife, of course, has the advantage over the clasp knife in that it is ready for action as soon as the hunter withdraws it from the scabbard.

OBJECTS OF THE INVENTION

It is an object of the invention to provide a new and improved holder for clasp knives. It is particularly an object of the invention to provide a holder for clasp knives in which the knife is ready for action as soon as it is removed from the holder. It is a further object of the invention to provide a clasp knife holder of the class described which has all the advantages of a clasp knife and none of the disadvantages of a hunting knife. It is a further object of the invention to avoid the disadvantages of the prior art and to obtain such advantages as will appear as the description proceeds.

SUMMARY OF THE INVENTION

The invention relates to a clasp knife holding device for holding a clasp knife having a blade spring-biased to closed position and is particularly directed to such device which comprises holding means for holding said knife in position to be grasped by a hand of the user; and knife blade-opening means in said holding means operative when said knife is withdrawn from said holding means to pull said blade at least to a position where it is no longer spring-biased to closed position.

Advantageously, the invention further comprises such a device in which said knife is also spring-biased to open position and in which said knife-blade opening means pulls said blade at least to a position where the spring bias to open position takes over and movement of the blade to open position is either completed by or augmented by the spring bias to open position.

More particularly, the invention further comprises such a device in which said holding means comprises a backbone member having a slotted face conforming substantially to the shape of the front of said knife and having a longitudinal slot therein conforming substantially to the length and thickness of said main blade and in which said knife-blade opening means comprises first detent means spanning said slot adjacent one end of said backbone member and adapted to be engaged by the cutting edge of the tip end of said blade and when so engaged, functioning to pull the front of said knife into firm contact with said slotted face by means of the spring bias to closed position, and second detent means projecting from the opposite end of said backbone member in position to hold the pivot end of said knife against longitudinal displacement beyond said second detent means and cooperating with said first detent means to hold said knife in said holding means with the cutting edge of the tip end of said blade pressing against said first detent means and yet permitting said knife to be withdrawn from said holding means, whereby, when said knife is grasped and pulled outwardly against the holding action of said first detent means, the main blade is held in said slot until the blade has been pulled to a position where it is no longer spring-biased to closed position.

Advantageously, such device comprises one or more further features, in which said knife is also spring-biased to open position and in which said first detent means holds said main blade at least until it has been pulled to a position where the spring bias to open position takes over and movement of the blade to open position is either completed by or augmented by the spring bias to open position; which further comprises third detent means projecting from said backbone member in position to engage the free end of said knife and cooperating with said second detent means to prevent longitudinal displacement of said knife in either longitudinal direction; in which said second and third detent means are integral parts of said backbone member; in which said holding means is laminated and in which an inner lamina has a thickness substantially that of said main blade and is cut away to form said slot; in which said backbone and said detent means are formed as a unitary block; in which said first detent means comprises hard knife sharpening material shaped to engage each side of the tip end of said blade and to hone the same as the knife is withdrawn from the holding means; in which said second detent means comprises an arm which projects normally from the bottom end of said backbone member and has a cup-shaped depression therein sloped to receive the pivot end of said knife and in which said third detent means comprises an arm which projects normally from the top end of said backbone member and is shaped to abut the free end of said knife and to allow the free end of said knife to be pulled from said holding means and said depression preventing the pivot end of said knife from being pulled from said holding means until after the free end of said knife has been pulled free of said third detent means; and, in which the arm of said second detent means has an upturned lip at the front edge of said depression which functions as a fulcrum when the knife is pulled from said holding means to cause said blade to move upwardly in said slot and the tip thereof to ride upwardly over said first detent means.

BRIEF DESCRIPTION OF THE DRAWINGS

In the drawings:

FIG. 1 is a side view;

FIG. 2 is a front view with parts broken away;

FIG. 3 is a cross-section taken along line 3—3 of FIG. 2;

FIG. 3A is a modified form of FIG. 3;

DESCRIPTION OF THE PREFERRED EMBODIMENTS

Figure 4:
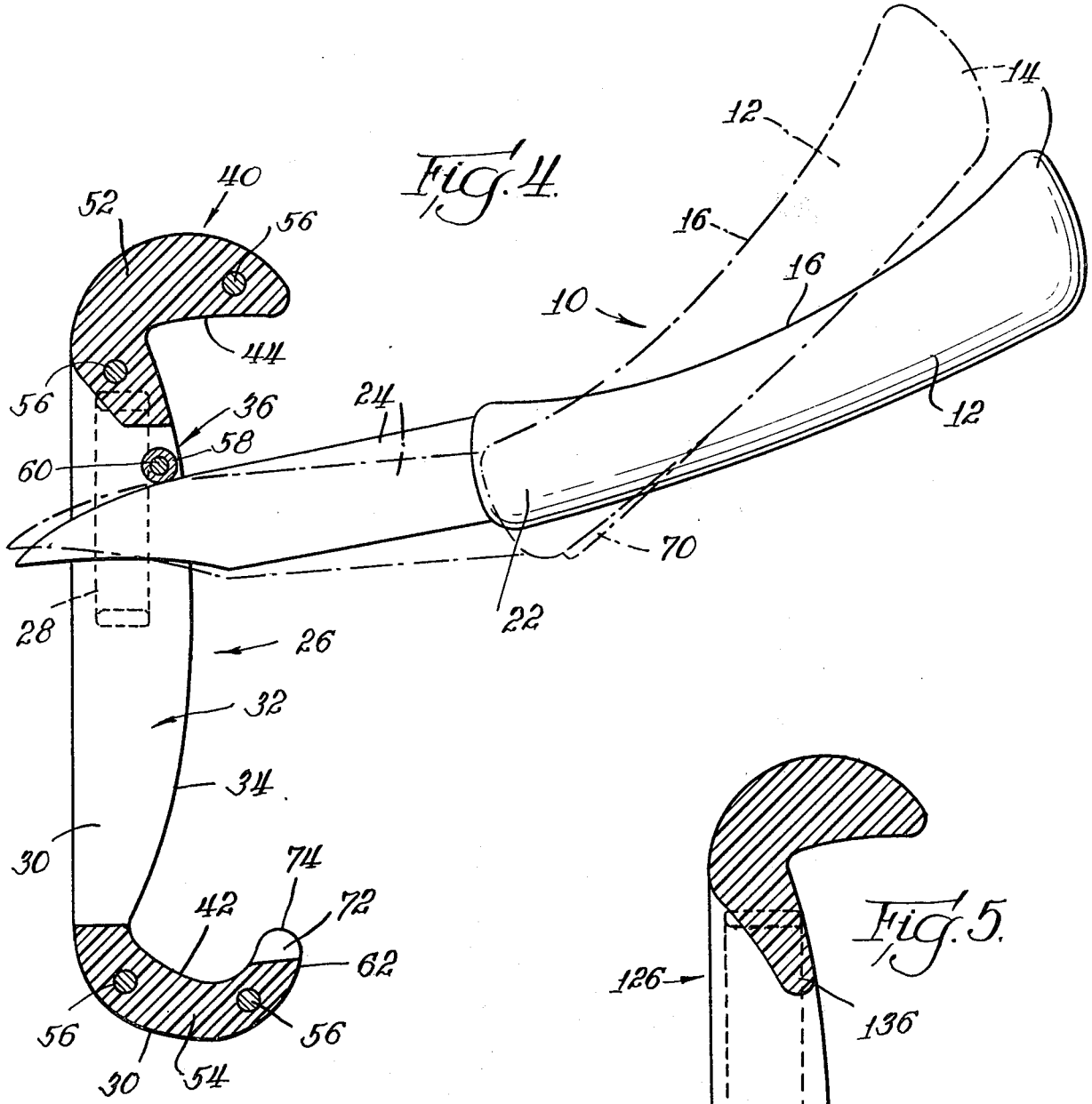
FIG. 4 is a side view showing the knife partially extracted from the holder; and, FIG. 5 is a side view in partial section of a modified form of the invention.

In FIGS. 1, 2, and 3, there is shown a clasp knife 10 having a handle 12 which has a free end 14, a front 16, a back 18, sides 20, and a pivot end 22. Pivoted in the pivot end 22 is a blade 24 adapted to be folded into the handle 12 or to be open to the position shown in FIG. 4.

As best seen in FIG. 2, the knife 10 is held in the holder 26 having a belt loop 28 for mounting it on the belt of the user.

The holder 26 comprises a backbone member 30 having a longitudinal slot 32 therein adapted to receive the blade 24. It has a slotted face 34 which conforms to the front 16 of the knife. The slot 32 is spanned by a first detent means 36 adjacent one end of the backbone member 30 and adapted to hold the blade 24 in partially open position, as shown in the unbroken lines of FIG. 2. In this position, the blade 24 is spring-biased to closed position and functions as a spring to pull the front 16 of the handle 12 into juxtaposition with the slotted face 34 of the backbone member 30. The knife is held in the position shown in FIG. 2 by second detent means 38 and third detent means 40 which are formed as integral, substantially normal projections from the backbone member 30.

The second detent means 38 has a cup-shaped depression 42 shaped to conform with the shape of the pivot end 22 of the knife, and the third detent means is shaped as shown at 44 to abut the free end 14 of the knife and yet allow it to be pulled free of the holder 26. Thus, when the handle 12 is grasped and pulled outwardly and upwardly, the blade 24 will be held back by the first detent 36, as shown in FIGS. 2 and 4, to the position shown in dotted lines in FIG. 4, where the blade will be snapped to the position shown in the unbroken lines. Thus, as shown in FIG. 2, the knife 10 is held firmly in the holder by the spring-bias of the blade to closed position and is opened by simply grasping the handle and pulling the knife outwardly and upwardly to the position shown in FIG. 4.

In the form of the invention shown in FIGS. 1–4, the holder 26 is built up of lamina or plates. The outer plates 46, advantageously, are made of brass, but could be made of any other hard, durable, attractive material. The inner plate 48, advantageously, is made of aluminum but, if desired, could be made of other soft durable material. And the intermediate plates, advantageously, are made of nylon, or like tough material having a low coefficient with metal. The intermediate plates 50 are spaced apart by the inner plate 48 to form a slot just wide enough to receive the blade 24 of the knife. The spacing shown in FIGS. 1 and 3 is exaggerated for the purpose illustration.

The inner plate 48 is cut away, as required, to form the slot 32. If desired, all the middle portion of the inner plate 48 can be cut away leaving only end pieces 52 and 54. If the two end pieces 52 and 54 are connected, the holder would have to be made wide enough so that the slot would be deep enough to accommodate the tip of the blade 24 in the position shown in FIGS. 2 and 4.

Plates 46, 48, and 50 are riveted together by rivets 56.

The detent 36, in the modification shown in FIG. 3, consists in a roller 58, mounted to rotate on the pin or rivet 60. Advantageously, it is made of brass or other soft, yet durable material which will not dull the blade 24.

At the front of the cup-shaped depression 42 is a lip 62 which extends upwardly sufficiently to form a fulcrum on which, as shown in the broken lines, the handle 12 rocks at the beginning of the pull. This forces the blade upwardly to the position shown in the dotted lines, thus causing the blade to move upwardly along the roller 58. This motion is augmented as the handle is pulled upward to a position shown in FIG. 4, after which the direction of motion is reversed and the blade is pulled out along the roller 58.

Figure 3B:
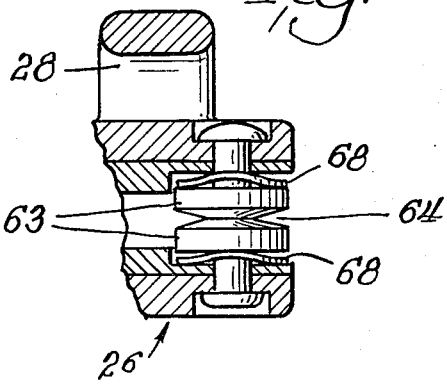
FIG. 3B is a further modified form of FIG. 3.

The motion just described has particular advantage in the form of the invention shown in FIGS. 3A and 3B, where the roller is shaped and constructed to function as a sharpening or honing device for the tip edge of the knife. Thus, as shown in FIGS. 3A and 3B, the roller can be constructed in the form of two beveled rollers 63 shaped to form a V-shaped slot 64 to receive the knife edge 65. The rollers are spring-pressed together by coil springs 66, as shown in FIG. 3A, or by spring washers 68, as shown in FIG. 3B. The wheels 62 can be made of any hard honing stone, such as Arkansas stone, or ceramic, or very fine emery, or of hardened steel. Thus, when the knife is withdrawn, as shown in FIGS. 2 and 4, the tip of the blade will be honed, first, as the blade moves upwardly, and then as the blade is withdrawn. Additionally, the user may find it to his advantage to deliberately hone the blade from time to time as he is using it for skinning or like operations which tend to dull the blade rapidly.

When the clasp knife is provided with a locking catch, as shown at 70, FIGS. 2 and 4, the lip 62 is provided with a slot 72 to accommodate the catch 70 when it is sprung out to the position shown in FIG. 2, thus allowing the pivot end of the knife to ride on the tip 74 of the lip 62.

Figure 5:
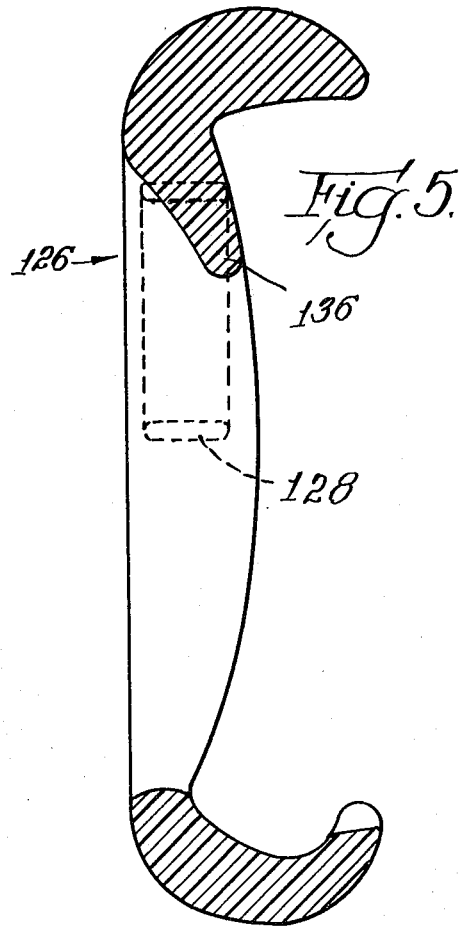

In the modification shown in FIG. 5, the holder 126 is cast or molded as a unitary piece from any suitable molding or casting material. The first detent 136 is shown as an integral part but, if desired, can be constructed as in FIGS. 3, 3A, and 3B. The belt loop 128 is also formed as an integral part of the casting or molding. Suitably, the holder 126 can be molded from nylon, polycarbonate, or like strong, durable plastic or, it can be cast from metals commonly used in die casting.

The invention is particularly useful in connection with a jackknife, such as used in hunting, as it makes the knife quickly and readily available to the hunter in emergency situations.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. A clasp knife holding device for holding a clasp knife having a handle and a main blade adapted to be folded into said handle and being spring-biased in such a manner that when it is moved toward closed position, a point is reached where it is spring-biased toward closed position and when it is moved toward open position, a point is reached where it is spring-biased toward open position, comprising holding means for holding said knife in position so that the handle can be grasped by a hand of the user, said knife blade being in a position in which it is spring-biased toward closed position; and knife blade opening means in said holding means operative when said knife is withdrawn from said holding means to pull said blade at least to a position where it is no longer spring-biased toward closed position.

2. A clasp knife holding device of claim 1, in which said knife blade opening means pulls said blade at least to a position where the spring bias to open position takes over and movement of the blade to open position is either completed by or augmented by the spring bias to open position.

3. A clasp knife holding device of claim 1, which further comprises sharpening means for honing said blade as it is withdrawn from said holding means.

4. A clasp knife holding device of claim 1, in which said holding means comprises a backbone member having slotted face conforming substantially to the shape of the front of said knife and having a longitudinal slot therein conforming substantially to the length and thickness of said main blade and in which said knife-blade opening means comprises first detent means spanning said slot adjacent one end of said member and adapted to be engaged by the cutting edge of the tip end of said blade and when so engaged functioning to pull the front of said knife into firm contact with said slotted face by means of the spring bias toward closed position, and second detent means projecting from the opposite end of said backbone member in position to hold the pivot end of said knife against longitudinal displacement beyond said second detent means and cooperating with said first detent means to hold said knife in said holding means with the cutting edge of the tip end of said blade pressing against said first detent means and yet permitting said knife to be withdrawn from said holding means, whereby, when said knife is grasped and pulled outwardly against the holding action of said first detent means, the main blade is held in said slot until the main blade has been pulled to a position where it is no longer spring-biased to closed position.

5. A clasp knife holding device of claim 4, in which said first detent means holds said main blade at least until it has been pulled to a position where the spring bias to open position takes over and movement of the blade to open position is either completed by or augmented by the spring bias to open position.

6. A clasp knife holding device of claim 5, which further comprises third detent means projecting from said backbone member in position to engage the free end of said knife and cooperating with said second detent means to prevent longitudinal displacement of said knife in either longitudinal direction.

7. A clasp knife holding device of claim 5, in which said backbone and said second and third detent means are integral parts of said holding means.

8. A clasp knife holding device of claim 7, in which said holding means is laminated and in which an inner lamina has a thickness substantially that of said main blade and is cut away to form said slot.

9. A clasp knife holding device of claim 5, in which said backbone member and said second and third detents are formed as a unitary block.

10. A clasp knife holding device of claim 4, in which said first detent means comprises hard knife sharpening material shaped to engage each side of the tip end of said blade and to hone the same as the knife is withdrawn from the holding means.

11. A clasp knife holding device of claim 6, in which said second detent means comprises an arm which projects normally from the bottom end of said backbone member and has a cup-shaped depression therein shaped to receive the pivot end of said knife and in which said third detent means comprises an arm which projects normally from the top end of said backbone member and is shaped to abut the free end of said knife and to allow the free end of said knife to be pulled from said holding means and said depression preventing the pivot end of said knife from being pulled from said holding means until after the free end of said knife has been pulled free of said third detent means.

12. A clasp knife holding device of claim 4, in which the arm of said second detent means has an upturned lip at the front edge thereof which functions as a fulcrum when the knife is pulled from said holding means to cause said blade to move upwardly in said slot and the tip thereof to ride upwardly over said first detent means.

13. A clasp knife holding device of claim 10, in which the arm of said second detent means has an upturned lip at the front edge thereof which functions as a fulcrum when the knife is pulled from said holding means to cause said blade to move upwardly in said slot and the tip thereof to ride upwardly over said first detent means.

14. A clasp knife holding device of claim 11, in which the arm of said second detent means has an upturned lip at the front edge of said depression which functions as a fulcrum when the knife is pulled from said holding means to cause said blade to move upwardly in said slot and the tip thereof to ride upwardly over said first detent means.

15. A clasp knife holding device of claim 12, in which said lip has a slot therein to accommodate a locking catch at the pivot end of said knife.

16. A clasp knife holding device of claim 13, in which said lip has a slot therein to accommodate a locking catch at the pivot end of said knife.

17. A clasp knife holding device of claim 14, in which said lip has a slot therein to accommodate a locking catch at the pivot end of said knife.

18. In combination, a clasp knife having a handle and a main blade adapted to be folded into said handle and being spring-biased in such a manner that when it is moved toward closed position, a point is reached where it is spring-biased toward closed position and when it is moved toward open position, a point is reached where it is spring-biased toward open position; holding means for holding said knife in position so that the handle can be grasped by a hand of the user, said knife blade being in a position in which it is spring-biased toward closed position; and knife blade opening means in said holding means operative when said knife is withdrawn from said holding means to pull said blade at least to a position where it is no longer spring-biased toward closed position.

19. A combination of claim 18, in which said knife blade opening means pulls said blade at least to a position where the spring bias to open position takes over and movement of the blade to open position is either completed by or augmented by the spring bias to open position.

* * * * *